US009562455B2

(12) United States Patent
Landes et al.

(10) Patent No.: US 9,562,455 B2
(45) Date of Patent: Feb. 7, 2017

(54) DOSING SYSTEM FOR A LIQUID REDUCING AGENT

(75) Inventors: Ewgenij Landes, Remseck (DE); Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 529 days.

(21) Appl. No.: 14/241,360

(22) PCT Filed: Jul. 9, 2012

(86) PCT No.: PCT/EP2012/063342
§ 371 (c)(1),
(2), (4) Date: Feb. 26, 2014

(87) PCT Pub. No.: WO2013/029849
PCT Pub. Date: Mar. 7, 2013

(65) Prior Publication Data

US 2014/0227120 A1 Aug. 14, 2014

(30) Foreign Application Priority Data

Aug. 26, 2011 (DE) ..... 10 2011 081 628

(51) Int. Cl.
*F01N 3/10* (2006.01)
*F01N 3/20* (2006.01)
(Continued)

(52) U.S. Cl.
CPC ..... *F01N 3/10* (2013.01); *F01N 3/208* (2013.01); *F01N 3/2066* (2013.01); *F01N 3/24* (2013.01); *F01N 2610/02* (2013.01); *F01N 2610/1433* (2013.01); *F01N 2610/1466* (2013.01); *F01N 2610/1473* (2013.01); *F01N 2610/1493* (2013.01); *F04B 23/10* (2013.01)

(58) Field of Classification Search
CPC ..... F01N 3/2066; F01N 3/208; F01N 3/206; Y10T 137/86163; F04B 23/04–23/14
USPC ..... 60/286, 295, 296, 297, 301, 303; 137/565.29, 565.33
See application file for complete search history.

(56) References Cited

U.S. PATENT DOCUMENTS 4,662,172 A * 5/1987 Shinzawa ..... F02B 3/02 431/248
5,433,238 A * 7/1995 Cannizzaro ..... C23C 16/4412 137/14
(Continued)

FOREIGN PATENT DOCUMENTS

CN 102099554 A 6/2011
DE WO 2004047963 A1 * 6/2004 ..... B01D 53/90
(Continued)

OTHER PUBLICATIONS

International Search Report for Application No. PCT/EP2012/063342 dated Sep. 19, 2012 (English Translation, 2 pages).

*Primary Examiner* — Alexander Comley
(74) *Attorney, Agent, or Firm* — Michael Best & Friedrich LLP

(57) ABSTRACT

Proposed is a dosing module for injecting liquid urea-water solution into the exhaust tract of an internal combustion engine, which dosing module is composed of two pumps, specifically a delivery pump (5) and an aeration pump (15). This permits firstly the injection of urea-water solutions and secondly safe and reliable ventilation of the system when the internal combustion engine is to be shut down.

19 Claims, 9 Drawing Sheets

(51) Int. Cl.
*F01N 3/24* (2006.01)
*F04B 23/10* (2006.01)

(56) References Cited

U.S. PATENT DOCUMENTS 5,522,218 A * 6/1996 Lane ..... B01D 53/9495 60/274
6,041,594 A * 3/2000 Brenner ..... B01D 53/90 239/427.5
6,050,088 A * 4/2000 Brenner ..... B01D 53/90 239/553.3
6,209,315 B1 * 4/2001 Weigl ..... B01D 53/9431 60/274
6,470,673 B1 * 10/2002 van Nieuwstadt ..... B01D 53/90 60/274
6,637,196 B1 * 10/2003 Tost ..... B01D 53/90 60/286
7,594,393 B2 * 9/2009 Offenhuber ..... A62C 3/07 60/286
7,793,491 B2 * 9/2010 Esaka ..... F02D 41/042 60/276
7,836,684 B2 * 11/2010 Starck ..... B01D 53/9431 60/286
7,849,674 B2 * 12/2010 Masuda ..... B01D 53/9409 60/286
8,459,012 B2 * 6/2013 Sun ..... 60/274
2003/0033799 A1 * 2/2003 Scheying ..... B01D 53/9431 60/286
2004/0025498 A1 * 2/2004 Lambert ..... B01D 53/90 60/286
2004/0060286 A1 * 4/2004 Huber ..... B01D 53/90 60/286
2004/0191093 A1 * 9/2004 Weigl ..... F01N 3/2066 417/413.1
2005/0252201 A1 * 11/2005 Lecea ..... F01N 3/2066 60/286
2007/0186543 A1 * 8/2007 Bakaj ..... F01N 3/2066 60/286
2007/0266699 A1 * 11/2007 Ripper ..... B01D 53/90 60/282
2007/0283685 A1 * 12/2007 Ripper ..... B01D 53/90 60/288
2009/0101656 A1 * 4/2009 Leonard ..... B01D 53/9431 220/562
2009/0194604 A1 * 8/2009 Smith ..... B05B 1/304 239/1
2009/0205316 A1 * 8/2009 Dougnier ..... F01N 3/2066 60/274
2010/0199648 A1 * 8/2010 Op De Beeck ..... F01N 3/2066 60/303
2011/0000196 A1 * 1/2011 Kasahara ..... F01N 3/2066 60/286
2011/0047972 A1 * 3/2011 Bauer ..... B01D 53/90 60/274
2011/0113765 A1 * 5/2011 Bruck ..... F01N 3/2066 60/303
2012/0031073 A1 * 2/2012 Grater ..... F01N 3/208 60/274
2012/0047880 A1 * 3/2012 Leonard ..... F01N 3/208 60/295

FOREIGN PATENT DOCUMENTS

DE 102009029408 3/2011
JP S59517 1/1984
JP 2000325754 11/2000
JP 2003003962 1/2003
JP 2004346808 12/2004
JP 2009508053 2/2009
JP 2011001895 1/2011
WO 2004047963 6/2004
WO 2012093051 7/2012

* cited by examiner

DOSING SYSTEM FOR A LIQUID REDUCING AGENT

BACKGROUND OF THE INVENTION

In internal combustion engines which operate according to the diesel process, an SCR catalyst is often provided in the exhaust gas system in order to meet environmental regulations. In order that the SCR catalyst can convert the NOx compounds contained in the exhaust gas to water and atmospheric nitrogen, a liquid urea-water solution (reducing agent) has to be injected into the exhaust tract upstream of the SCR catalyst. To this end, a dosing system comprising a tank, a pump and a dosing module, which operates similarly to the injector of a fuel injection system, is used. The pump is also referred to as the delivery module.

It is the task of the delivery module or the pump to draw urea-water solution from a tank and to build up a sufficient pressure on the pressure side so that the liquid urea-water solution is finely atomized as soon as the dosing module opens in a demand-controlled manner. Just as the delivery module, the injector is connected to a control device of the internal combustion engine and is opened by said device in accordance with the demand and closed again by the same. The same process also applies to the operation of the delivery pump. Because urea-water solution has the property of freezing at low temperatures and thereby increasing the volume thereof by approximately 11%, measures must be taken to prevent damage to the dosing system due to freezing urea-water solution.

For this reason, it is known from the German patent application DE 10 2004 054 238 to aerate the lines carrying the urea-water solution. To this end, the pump is designed having a reversible delivery direction, or a valve for reversing the delivery direction of the pump is provided.

It is known from the German patent application DE 10 2009 029 408 to integrate a 4/2-way valve into the dosing system. In a first switching position of the 4/2-way valve, the pump delivers reducing agent from the tank to the dosing module. When the internal combustion engine is to be shut down, the 4/2-way valve is brought into the second switching position; thus enabling the pump of the delivery module to deliver liquid reducing agent from the dosing module to the tank and thereby ventilate parts of the dosing system. This assumes that the dosing module is open and air or exhaust gas can flow out of the exhaust tract into the dosing system.

By the partial aeration of the dosing system, a compressible air bubble forms so that when the remaining residues of the reducing agent freeze in the dosing system, the resulting ice pressure is so small that no damage occurs to the dosing system. Such a 4/2-way valve is however subject to malfunction and expensive.

SUMMARY OF THE INVENTION

The inventive dosing system is characterized in that said system is very cost effective and ensures a reliable evacuation or aeration of the dosing system after shutting down the internal combustion engine. Because the inventive aeration pump only serves to aerate or evacuate the dosing system, a very small delivery rate is sufficient. Moreover, only small demands are placed on the delivery pressure of the aeration pump. This leads to the aeration pump according to the invention being more cost effective than a 4/2-way valve. In addition, such a pump is less subject to malfunction than a switchable 4/2-way valve.

The inventive delivery pump and/or the inventive aeration pump are preferably designed as diaphragm pumps. The invention is however not limited to diaphragm pumps. Other designs known from the prior art can also be used.

It has proven to be particularly advantageous if the inventive delivery pump and/or the inventive ventilation pump are driven by an electromagnetic (linear) actuator, which is also referred to as a solenoid. The system can then namely forego a conversion of the rotational movement of an electric motor into, for example, an oscillating conveying movement of the pump.

In a very simple and cost effective manner, the direct drive of the diaphragm pump via an electromagnetic actuator allows the injected quantity of the reducing agent to be ascertained very precisely via the stroke of the actuator.

For example, the stroke of the actuator can be inferred from the profile of the armature current through the electromagnetic actuator. The stroke of the actuator is a direct measurement for the conveyed quantity of the reducing agent. It is therefore possible to dispense with a separate pressure sensor without compromising the dosing accuracy of the dosing system according to the invention.

In order to optimize the operation of the delivery pump and/or the ventilation pump, a check valve is provided in each case on the suction side and/or the delivery side of both pumps. It is also alternatively possible for a throttle or a diaphragm to be provided either on the suction side or the delivery side and a check valve to be provided either on the pressure side or the suction side.

In an advantageous embodiment of the dosing system according to the invention, a second check valve is provided on the suction side of the aeration pump parallel to the first check valve, wherein the blocking direction of the second check valve is opposite to the blocking direction of the first check valve.

It is thereby possible to use the aeration pump according to the invention as a pressure equalization element. If an inadmissibly high pressure namely occurs in the pressure line during the operation of the delivery pump, damage can thereby occur to the dosing module or the pressure line.

In the dosing system according to the invention, the aeration pump is used as a pressure equalization element during the operation of the delivery pump. If too high a pressure prevails specifically in the pressure line so that the first check valve on the suction side of the aeration pump opens, the high pressure from the pressure line then acts on the diaphragm of the aeration pump. The diaphragm can yield to this high pressure by said diaphragm expanding in the direction of the electrical actuator. As a result, the volume on the pressure side of the inventive dosing system increases and the pressure spike is dissipated.

It is also alternatively possible to configure the pressure-side check valve in the aeration line in such a manner that said check valve opens when an inadmissibly high pressure occurs in the pressure line and therefore a portion of the urea-water solution conveyed by the delivery pump flows out of the pressure line back into the suction line. In so doing, an effective pressure limitation is likewise achieved. In addition, no additional costs are necessary to achieve this end.

Of course, a combination of the two variants, namely of the elastic deformation of the diaphragm of the aeration pump and the opening of the aeration line, can be implemented.

Provision is made in a further advantageous embodiment of the invention for a throttle or a diaphragm to be provided on the pressure side of the aeration pump parallel to the check valve. By means of said throttle or diaphragm, the electrical actuator can be of smaller design. As a result, the electrical power consumption is reduced. In addition, weight requirements as well as installation space requirements are reduced.

In the case of diaphragm pump, provision is made in a particularly advantageous embodiment of the invention for the diaphragm to seal off the aeration line on the pressure side or the suction side of the aeration pump when the actuator is not being supplied with current. In so doing, the aeration pump according to the invention assumes the function of a switchable directional valve without additional use of and expenditure for components. This is possible because the delivery operation, i.e. when the diaphragm presses reducing agent out of the delivery chamber into the aeration line, is performed by a spring acting on the diaphragm.

By means of a suitable constructive embodiment, it is therefore readily possible for the diaphragm to be pressed by the spring against the connection of the aeration line in the pump housing and therefore closing the same.

In order to increase the sealing effect or the maximum pressure in the delivery chamber against which the diaphragm of the aeration pump can seal off the aeration line, a cross-sectional constriction in the housing can be provided. Said cross-sectional constriction can concurrently be configured as a throttle or a diaphragm.

It is furthermore possible to increase the impermeability or the maximum holding pressure/closing pressure of the diaphragm by an annular bead being configured which surrounds the end of the pressure line or the suction line. As a result, an increased surface pressure occurs between the bead and the diaphragm; thus enabling the impermeability of the diaphragm pump used as a controllable directional valve to be increased. The costs for the additional bead are also thereby insignificant because the housing of the pumps is, generally speaking, manufactured as a plastic injection molded part or as a cast metal part and thus no additional manufacturing costs for the bead are incurred.

It is also alternatively possible for the membrane to directly or indirectly exert a closing force on a valve member of the check valves when the actuator of the delivery pump and/or the aeration pump is deenergized. As a result, the impermeability of the check valves is increased. This too can be achieved without additional manufacturing costs. This improved impermeability makes it possible to simultaneously reduce the pre-load on the closing springs in the check valves. The delivery work to be provided by the electromagnetic actuator is thereby reduced; and the electromagnetic actuator can therefore be of smaller, more energy efficient and more cost effective design. This is an aspect which relates to the aeration pump as well as to the delivery pump.

In order to achieve a particularly compact design, provision is furthermore made for the aeration pump to be integrated into the delivery pump. This not only has advantages with regard to the hydraulics of the dosing system but additionally has the advantage that the signal lines for actuating both pumps can be conjointly guided into the housing.

In the instance that the reducing agent freezes in the delivery pump, there is furthermore the advantage that the aerated delivery chamber of the aeration pump, which chamber does indeed serve as a compensation volume for the reducing agent situated in the delivery pump, is located in direct proximity to the delivery pump and thus the pressure equalization between the two pumps is very well possible.

According to an advantageous embodiment of the inventive dosing system, at least one capacitor is provided so that the electrical charge stored in the capacitor can be used to energize the electrical actuator. Because a capacitor can very quickly release the electrical charge stored therein, it is possible, should necessity require it, to very quickly apply large currents to the actuator of the aeration pump; thus enabling the diaphragm to be abruptly raised which results in a very rapid suction of liquid reducing agent by the aeration pump. Due to this dynamic suction process, a so-called pulse back suction of liquid reducing agent takes place. Said pulse back suction is ultimately nothing other than the utilization of the elasticity of the pressure line and of the liquid reducing agent that is subjected to pressure therein. In the case of an abrupt drop in pressure, the pressure line compresses to some extent and thereby delivers a small amount of liquid reducing agent in the direction of the aeration pump. This leads to at least a part of the pressure line as well as the dosing module being no longer filled with liquid reducing agent but instead with air or exhaust gases. As a result, the risk of damage due to ice pressure is reduced.

Provision is made in a further advantageous embodiment of the dosing system according to the invention for the delivery pump and/or the aeration pump to include an electrical actuator comprising a magnet and an armature, a diaphragm, a valve diaphragm plate and a valve plate and for a rubber plate serving as a valve element and sealing element to be provided between the valve diaphragm plate and the valve plate.

The check valves according to the invention and/or throttles can be manufactured in a simple and cost effective manner by means of this sandwich-like design of the delivery pump and/or the aeration pump. Thus, an additional aperture in the valve plate has, for example, only to be provided for an additional check valve, and corresponding recesses are to be provided in the rubber plate acting as a valve element.

In a similar manner, it is possible for the valve diaphragm plate and the diaphragm of the aeration pump together with the electrical actuator to form a controllable shut-off valve. This too does not require any significant additional manufacturing costs.

In a further advantageous embodiment of the invention, a valve disk is formed on the armature, said disk working together with a sealing bead of the valve diaphragm as a switchable directional or check valve. Provision is furthermore made for the diaphragm to be disposed on the armature so as to be offset with respect to the valve disk. As a result, it is possible that, on the one hand, the pressure prevailing in the delivery chamber acts to some extent on the back side of the valve disk and consequently presses the same against the sealing seat in the valve diaphragm plate. As a result, the impermeability is increased. At the same time, it is possible for the diaphragm to give way in the stroke direction and thus dissipate a pressure spike. The diaphragm can thus operate as a pressure equalization element. In order to be able to constructively define the elasticity of the diaphragm within narrow limits, it is advantageous to design the diaphragm wavelike in cross section. At the same time, it is advantageous if the armature of the electrical actuator delimits the travel of the diaphragm in the stroke direction so that there is no risk of bursting or tearing of the diaphragm when inadmissible high pressures are applied to said diaphragm.

BRIEF DESCRIPTION OF THE DRAWINGS

Further advantages and advantageous embodiments of the invention can be extracted from the following drawings, the description of said drawings and the patent claims. In the drawings:

DETAILED DESCRIPTION

Figure 1:
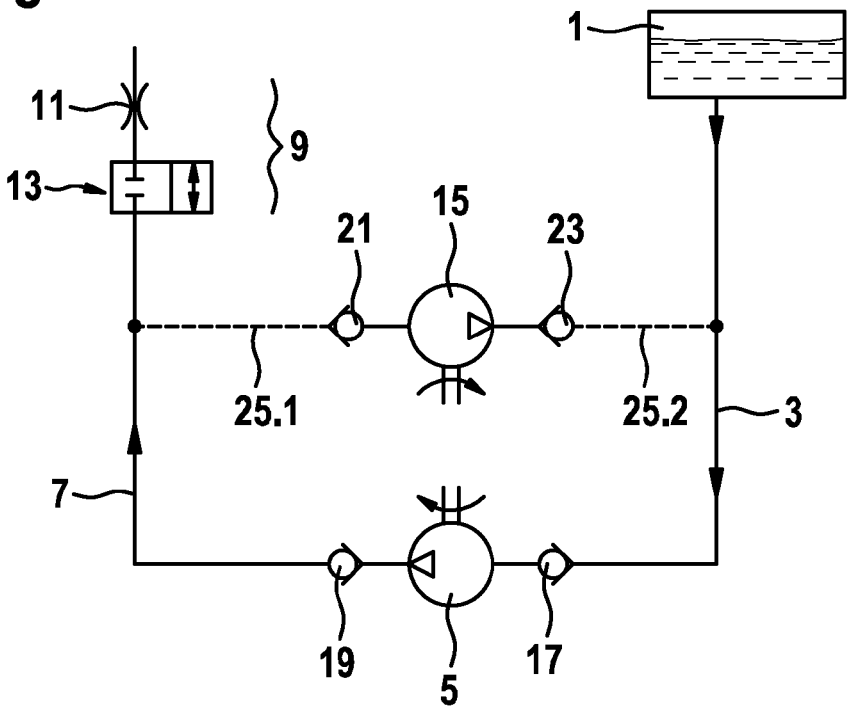
FIG. 1 shows a block diagram of a first exemplary embodiment of a dosing system according to the invention.

A first exemplary embodiment of a dosing system according to the invention is depicted as a block diagram in FIG. 1. Liquid reducing agent (urea-water solution) is situated in a tank 1. A delivery pump 5 draws liquid reducing agent as required out of the tank via a suction line 3 and delivers the same via a pressure line 7 to a dosing module 9. The terms suction line 3 and pressure delivery line 7 relate to the normal operation of the dosing system when reducing agent is namely being delivered from the tank to the dosing module 9.

The dosing module 9 is depicted in the block diagram as a combination of a throttle 11 and a switchable 2/2-way valve 13. The directional valve 13 is closed in the deenergized state. No liquid reducing agent is then injected into the exhaust tract of the internal combustion engine (not depicted). If reducing agent is being delivered by the delivery pump 5 and therefore the reducing agent is subjected to an increased pressure in the pressure line 7, the directional valve 13 can be opened by the engine control device (not depicted); thus enabling liquid reducing agent from the throttle 11 to be atomized in the dosing module 9 and injected into the exhaust pipe of the internal combustion engine in a finely dispersed manner.

The quantity of liquid reducing agent injected into the exhaust tract can be controlled by the delivery pressure of the delivery pump 5 and the opening time of the directional valve 13. In the dosing system according to the invention, an inventive aeration pump 15 is provided in parallel with the delivery pump, however having an opposite delivery direction.

If the delivery pump 5 is in operation, the aeration pump 15 is not in operation and vice versa. There are however operating states of the dosing system according to the invention in which neither of the two pumps 5, 15 is in operation.

A check valve 17, 19 is provided in each case on the suction side and the delivery side 5 of the delivery pump 5. In a corresponding manner, check valves 21 and 23 are likewise provided on the suction side and the pressure side of the aeration pump 15. Because the delivery directions of the delivery pump 15 and the aeration pump 15 are opposite to one another, the blocking directions of the check valves 17, 19 and 21, 23 are also oppositely oriented.

The aeration pump 15 is hydraulically integrated into the suction line 3 and the pressure line 7 of the delivery pump 5 via an aeration line 25. The suction-side (in relation to the aeration pump 15) section of the aeration line 25 has the reference numeral 25.1. The pressure-side (in relation to the aeration pump 15) section of the aeration line 25 has the reference numeral 25.2.

In the normal operation of the dosing system depicted in FIG. 1, the check valves 21 and 23 block the aeration line 25 as long as the pressure in the pressure line 7 lies below the opening pressure of said check valves.

Figure 2:
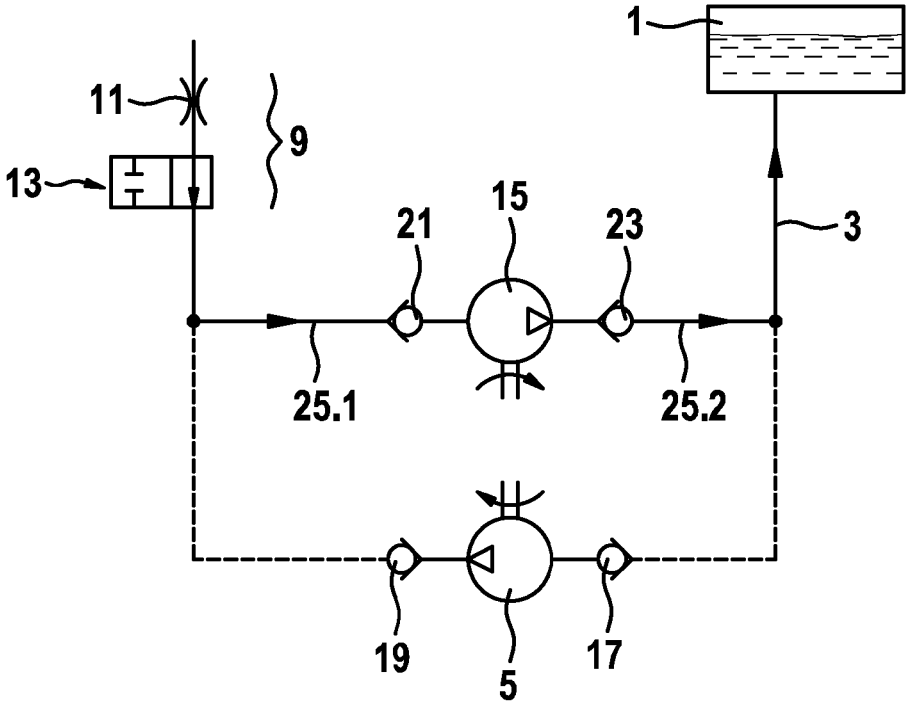
FIG. 2 shows the exemplary embodiment pursuant to FIG. 1 when the system is being aerated.

The same exemplary embodiment of the dosing system according to the invention is depicted in FIG. 2 in the operating mode: aeration. In this case, the delivery pump 5 is not in operation and the aeration pump 15 delivers liquid reducing agent from the dosing module 9 back into the tank 1. In order that the aeration pump 15 can aerate the dosing module 9 as well as a portion of the pressure line 7, the 2/2-way valve 13 of the dosing module 9 is open. This switching position is depicted in FIG. 2.

During the aeration of the dosing system depicted in FIG. 2, the check valves 17 and 17 block sections of the suction line 3 and the pressure line 7 as long as the delivery pressure of the aeration pump 15, 7 lies below the opening pressure of said check valves.

As soon as the aeration process has concluded, the directional valve 13 of the dosing module 9 is closed again and the aeration pump 15 is switched off.

After the aeration process, the dosing module 9 as well as portions of the pressure line 7, the aeration line 25 and the aeration pump 15 are filled with air or exhaust gas. The aforementioned regions that are filled with air are therefore available as a compensation volume to the regions of the dosing system that are still filled with liquid reducing agent, specifically above all the delivery pump 5, the suction line 3 and a portion of the pressure line 7, in the event that the reducing agent freezes. As a result, the forces occurring upon freezing of the reducing agent are reduced to the point where there is no longer risk of damage to the delivery pump 5 or the lines 3, 7. This applies particularly to the case where the delivery pump 5 and the aeration pump 15 are disposed in a common housing.

Figure 3:
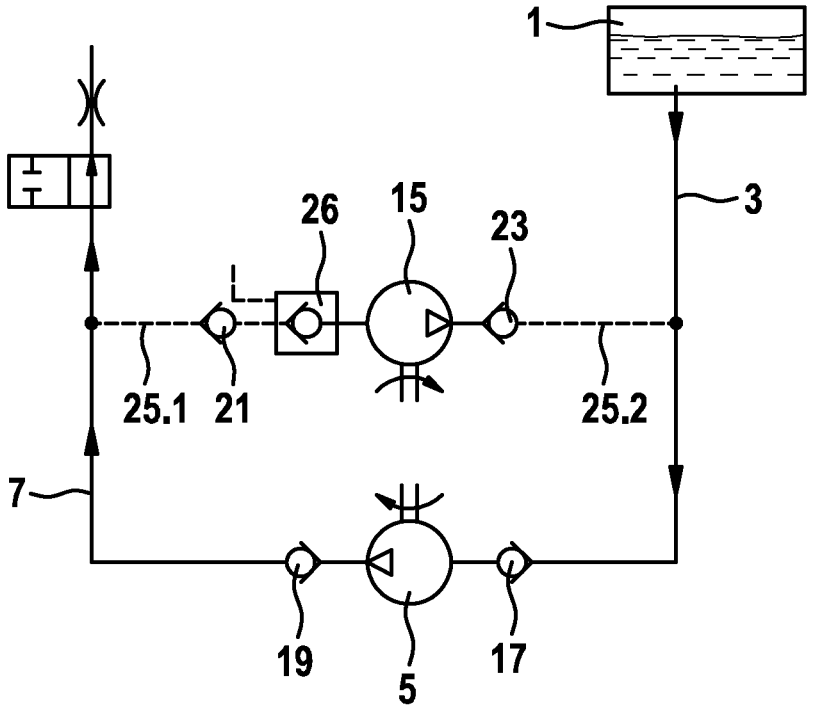
FIG. 3 shows the block diagram of a second exemplary embodiment, in which the aeration pump embodied as a diaphragm pump simultaneously operates as controlled check valve during the normal operation of the dosing system.

A second exemplary embodiment of the dosing system according to the invention is depicted in FIG. 3. A significant difference to the first exemplary embodiment is that the aeration pump 15 that is configured as a diaphragm pump is designed in such a manner that the diaphragm of the aeration pump 15 seals off the aeration line 15 whenever said aeration pump is deenergized. This is demonstrated by means of a switchable directional valve 26. The section 25.2 of the aeration line 25 is thereby preferably closed although the directional valve 26 is illustrated in the section 25.1.

As soon as the actuator of the aeration pump 15 is energized, the diaphragm again unblocks the aeration line 25; thus enabling the operating mode described with the aid of FIGS. 1 and 2 to again take place. The aeration pump 15 pursuant to the second exemplary embodiment has then additionally the function of a controlled shut-off valve 26. Because no additional components are required to meet this end, this additional functionality is achieved without extra costs.

The use of the delivery pump as a controlled shut-off valve 26 has the advantage that the aeration line 25 can be sealed off using very little spring pressure of the spring acting on the diaphragm by means of an appropriate design of the cross section of said aeration line. As a result, it is no longer necessary for one of the two check valves 21, 23 in the aeration line to be designed such that said valve is still leak tight with respect to the operating pressure of the delivery pump 5.

The opening pressure of the check valves 21 and 23 should be as low as possible because the electromagnetic actuator of the aeration pump 15 has to overcome the opening pressure with each stroke. The actuator can be designed smaller and lighter proportionally to how low the opening pressure is. By using the diaphragm of the aeration pump 15 as an additional shut-off valve, not only the opening pressure of the check valves 21, 23 can thus be reduced but the electromagnetic actuator of the aeration pump 15 can be of smaller design which saves on costs and installation space. In so doing, the power requirement for driving the aeration pump 15 is furthermore reduced.

Figure 4:
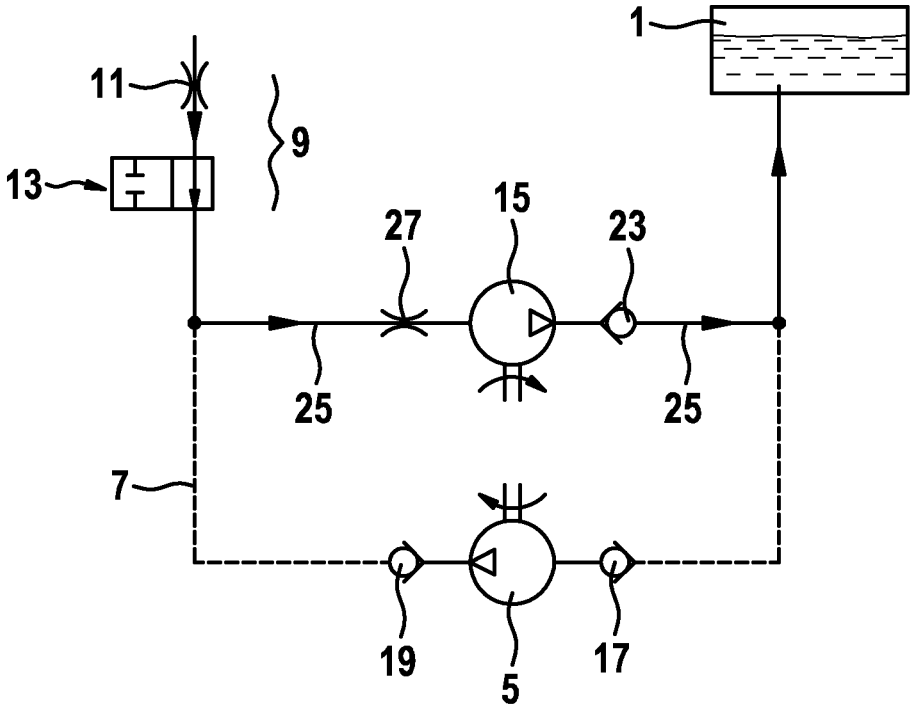
FIG. 4 shows a third exemplary embodiment of an inventive dosing system comprising a throttle instead of a check valve on the suction side of the aeration pump.

In the exemplary embodiment depicted in FIG. 4, a suction throttle 27 is provided on the suction side of the aeration pump 15 instead of a check valve 21 (see FIGS. 1 to 3). Because the suction throttle 27 ultimately substantially consists only of a cross-sectional constriction in the aeration line 25, the number of required components is thereby again reduced, which has a positive effect on the manufacturing costs and the robustness of the dosing system according to the invention.

Figure 5:
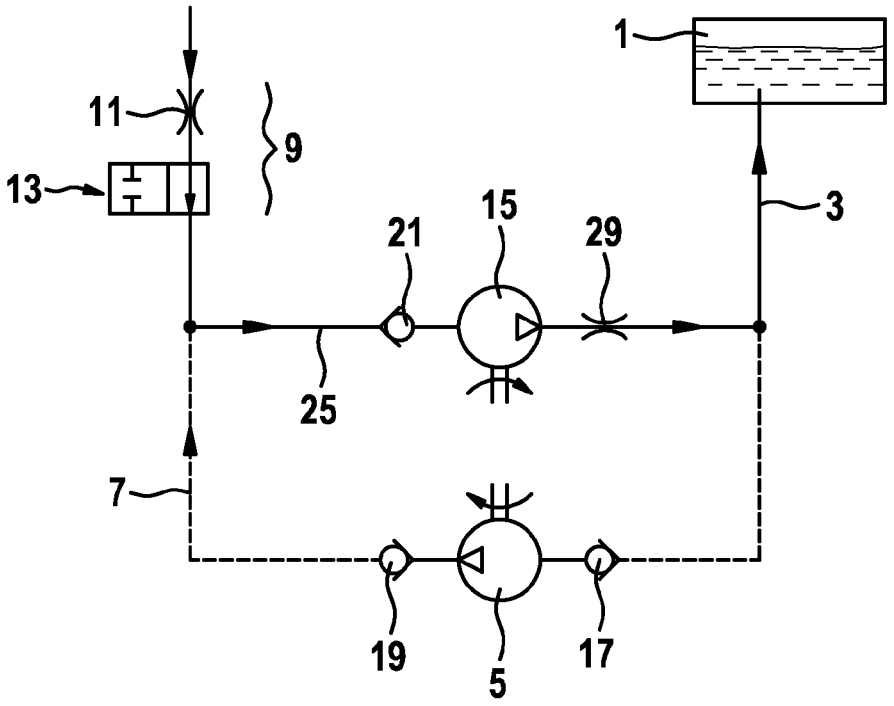
FIG. 5 shows a further exemplary embodiment of an inventive dosing system comprising a throttle on the pressure side/delivery side of the aeration pump according to the invention.

As can be seen in FIG. 5, the check valve 23 can also be replaced on the pressure side of the aeration pump 15 by a feed throttle 29. It is important however that at least one check valve is present in the aeration line 25.

It goes without saying that the diaphragms of the delivery pump 5 as well as of the aeration pump 15 can be driven not only via an electromagnetic actuator but also by an electric motor. Another pump principle, such as, e.g., a piston pump, a gear pump or a vane pump among other things, can also be used.

Depending on need and design, the check valves 17, 19, 21 and/or 23 can be loaded by spring elements so that the opening pressure of said check valves can be adjusted within wide limits by means of the preload force of the springs. Said check valves can also be partially replaced by throttles as explained using the exemplary embodiments pursuant to FIGS. 4 and 5.

Filters which are possibly necessary on the suction side 3, in the pressure line and/or in the aeration line 25 are partially required in practical applications but are not depicted for reasons of clarity. The same also applies to a pressure sensor or a flow rate sensor. If possible, the installation of such sensors should be avoided because they drive costs up. If necessary, an additional electrical heater can be installed. This is, however, not required in many cases because the waste heat of the pump drive is usually sufficient in preventing the dosing system from freezing. This, of course, does not apply to the liquid reducing agent situated in the tank 1. In many cases, a heater is required here at least to thaw the frozen reducing agent (not depicted).

Figure 6:
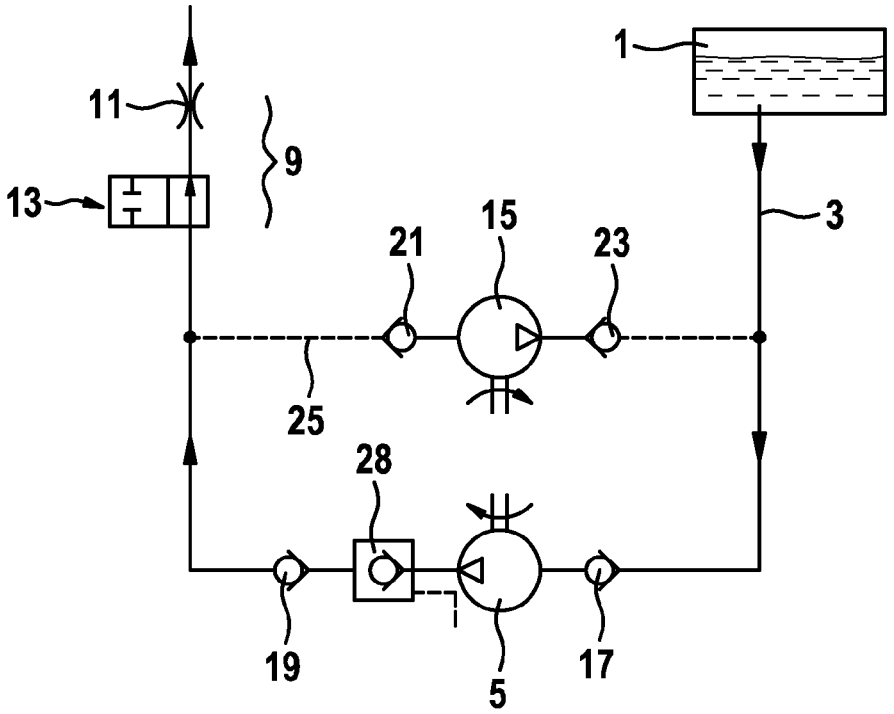
FIG. 6 shows a further exemplary embodiment of an inventive dosing system in which the diaphragm of the delivery pump is used as a controlled check valve.

A further exemplary embodiment of a dosing system according to the invention is depicted in FIG. 6. In this exemplary embodiment, the delivery pump is designed as a diaphragm pump and can also be used in a similar manner, as explained using FIG. 3, as a switchable shut-off valve 28. Reference is therefore made in this case to that which has been described in connection with the aeration pump 15 in FIG. 3.

Figure 7:
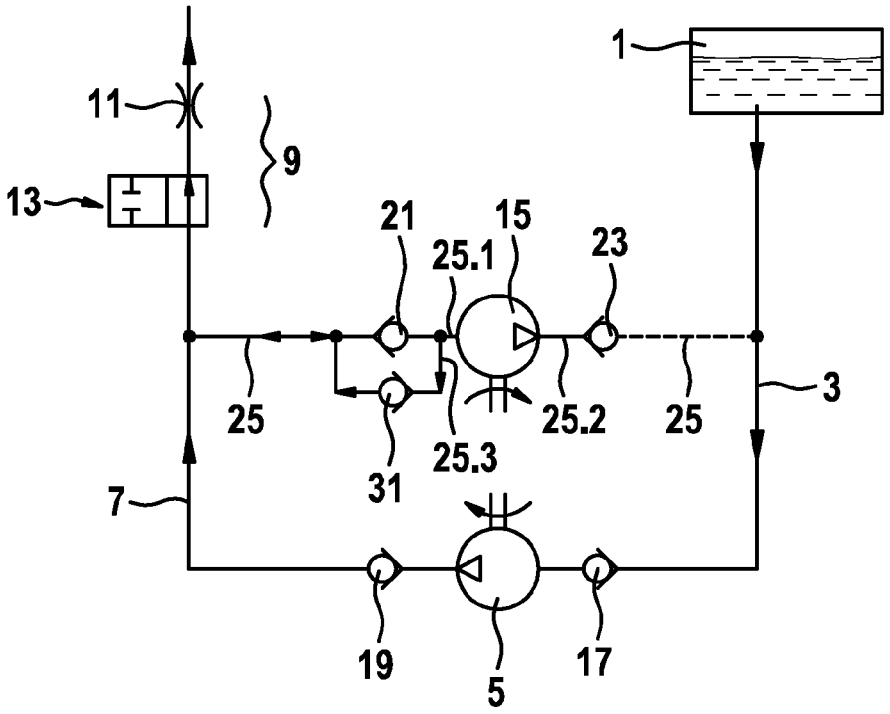
FIGS. 7 & 8 show further exemplary embodiments of dosing systems according to the invention and FIGS. 9-16 show constructive details of different exemplary embodiments of aeration pumps according to the invention.

FIG. 7 depicts a block diagram of a further exemplary embodiment of the dosing system according to the invention. In this exemplary embodiment, a second check valve 31 is provided in parallel with the first check valve 21 on the suction side of the aeration pump 15. The blocking directions or the passage directions of the check valves 21 and 31 are thereby opposite to one another.

If, for example, an inadmissibly high pressure now occurs in the pressure line 7 during the operation of the delivery pump 5, the first check valve 21 then opens. As a result, the diaphragm (not depicted in FIG. 7) of the aeration pump 15 is impinged with the higher pressure and said diaphragm is displaced due to the higher pressure. The volume of the delivery chamber in the aeration pump 15 is thereby enlarged, and the pressure spike is thus partially reduced. As soon as the pressure in the pressure line 7 returns again to normal values, the elastic diaphragm of the aeration pump 15 can push the quantity of liquid urea-water solution previously received in the delivery chamber back into the pressure line until an equalization of pressure occurs.

If the excess pressure in the pressure line 7 is very high, it is also possible that the check valve 23 on the pressure side of the aeration pump 15 opens and a portion of the liquid delivered by the delivery pump 5 is led out of the pressure line 7 and back into the suction line 3. As a result, a drop in pressure to admissible values or a pressure limitation also takes place. The system according to the invention is therefore very robust and does not incur damage even when inadmissibly high pressures occur.

Figure 8:
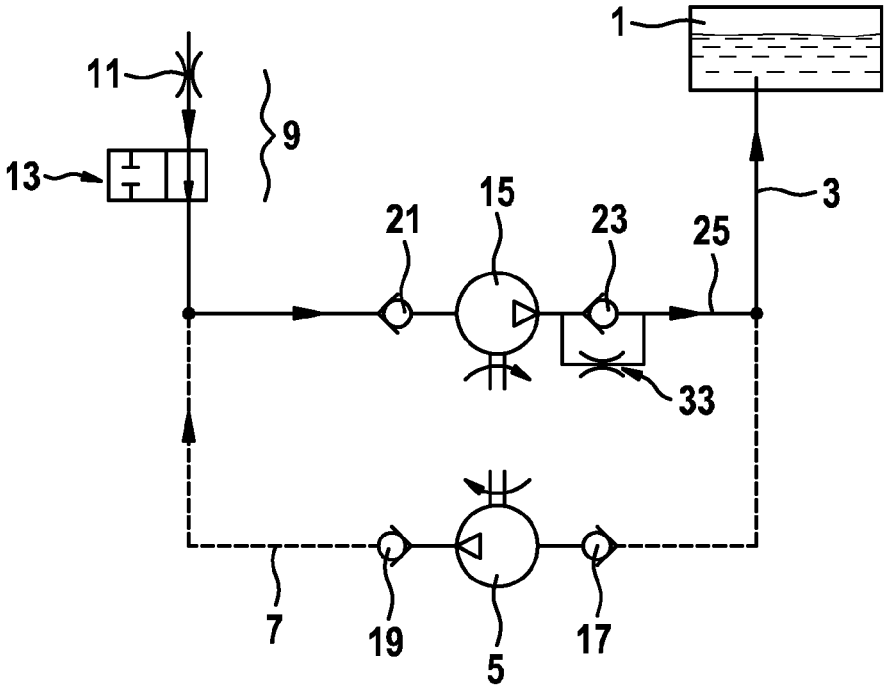

In the exemplary embodiment pursuant to FIG. 8, a throttle 33 is provided in parallel with the check valve 23 on the pressure side of the aeration pump 15. By means of said throttle, it is possible for the actuator to be of smaller design. It has actually been found that a strong negative pressure can develop in the delivery chamber of the aeration pump 15 during the suction phase of the delivery pump 5 particularly if the diaphragm of the aeration pump 15 is designed as an additional shut-off valve 26 or pressure retention valve 26. This results from the fact that the delivery chamber is connected via the aeration line 25 and the check valve 23 to the suction line 3. The blocking action of the check valve 23 prevents an equalization in pressure between the delivery chamber of the aeration pump 15 and the suction line 3 if a negative pressure prevails in the delivery chamber.

Said negative pressure in the delivery chamber can only be overcome by a very strong electrical actuator. By means of the throttle according to the invention, it is ensured that an equalization in pressure between the delivery chamber of the aeration pump 15 and the suction line 3 can take place if negative pressure prevails in the delivery chamber. As a result, the drive capacity of the electrical actuator can be reduced, which has a positive effect on the installation space requirements and the weight of the electrical actuator. Further details in this regard ensue from FIGS. 14-16 and the descriptions thereof.

Figure 9:
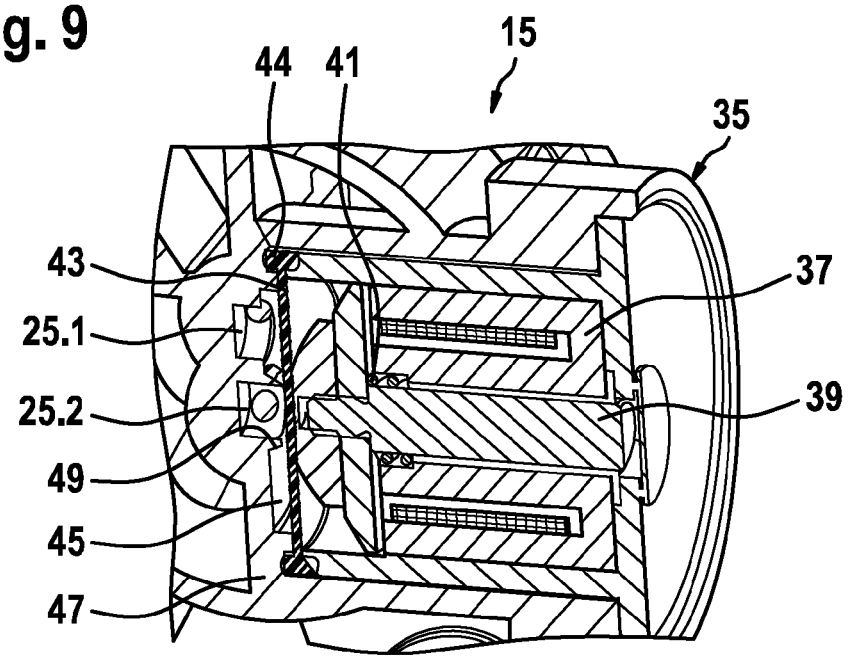

A longitudinal section through an exemplary embodiment of an aeration pump 15 according to the invention is depicted in FIG. 9.

The electrical actuator 35 essentially comprises an electromagnet 37 and an armature 39. A spring 41 is located between the magnet 37 and the armature 39, said spring pressing the armature 39 in FIG. 9 to the left against a diaphragm 43. By means of a bead 44, the diaphragm 43 is externally clamped in a sealing manner in the housing 47 of the aeration pump 15. Thus, no liquid is situated to the right of the diaphragm 43 in FIG. 9. On the other side of the diaphragm 43, a delivery chamber 45 of the aeration pump 15 is configured in the housing 47. Besides the delivery chamber 45, the connections of the sections 25.1 and 25.2 are indicated in the housing 47 of the aeration pump 15. The suction-side connection of the aeration pump 15 to the aeration line 25 is thereby denoted with the reference numeral 25.1; whereas the connection 25.2 denotes the pressure-side connection of the aeration pump 15 to the aeration line 25. The check valves 21 and 23 are not depicted in FIG. 9. An annular sealing seat 49 is formed in the housing in the region of the pressure-side connection 25.2.

If the electrical actuator is deenergized, the spring 41 then pushes the armature 39 and with it the diaphragm 43 against the sealing seat 49 so that the connection 25.2 of the aeration line 25 is closed. As soon as the electrical actuator 35 is energized, the magnet 37 moves the armature in FIG. 9 to the right; thus enabling the diaphragm 43 to lift off the sealing seat 49 and consequently a hydraulic connection is produced between the connection 25.1 and the delivery chamber 45. The inventive aeration pump 15 pursuant to the exemplary embodiment of FIG. 9 is thus simultaneously a controllable directional valve which closes the connection 25.2 of the aeration line 25 when power is switched off to the actuator 35. This functionality does not require any additional components. It is achieved by an artful constructive design and tuning of the diaphragm 43, the pump housing or the sealing seat 49 as well as electrical actuator 35. As a result, no additional costs are incurred during manufacture.

If the electrical actuator 35 is abruptly energized due to the discharge of one or a plurality of capacitors (not depicted), the armature is then pulled very quickly and with a large force so that a substantial and sudden drop in pressure occurs in the region of the pressure line 7 and a section 25.1 of the aeration line 25. Due to the elasticity of the pressure line 7 or the aeration line 25 and the liquid which is situated therein and is subjected to pressure, the abrupt pressure release leads to a portion of the liquid situated in the pressure line 7 being pressed by the aeration pump 15 in the direction of the tank. As a result, a partial aeration of the dosing module 9 and the pressure line 7 is ensured even by means of a delivery stroke of the aeration pump 15 which admittedly occurs very quickly, so that no damage results from ice pressure even in the event that the system subsequently freezes. This highly dynamic process is referred to as pulse back suction in the context of the invention and can be employed in all inventive exemplary embodiments of dosing systems or aeration pumps 15.

Figure 10:
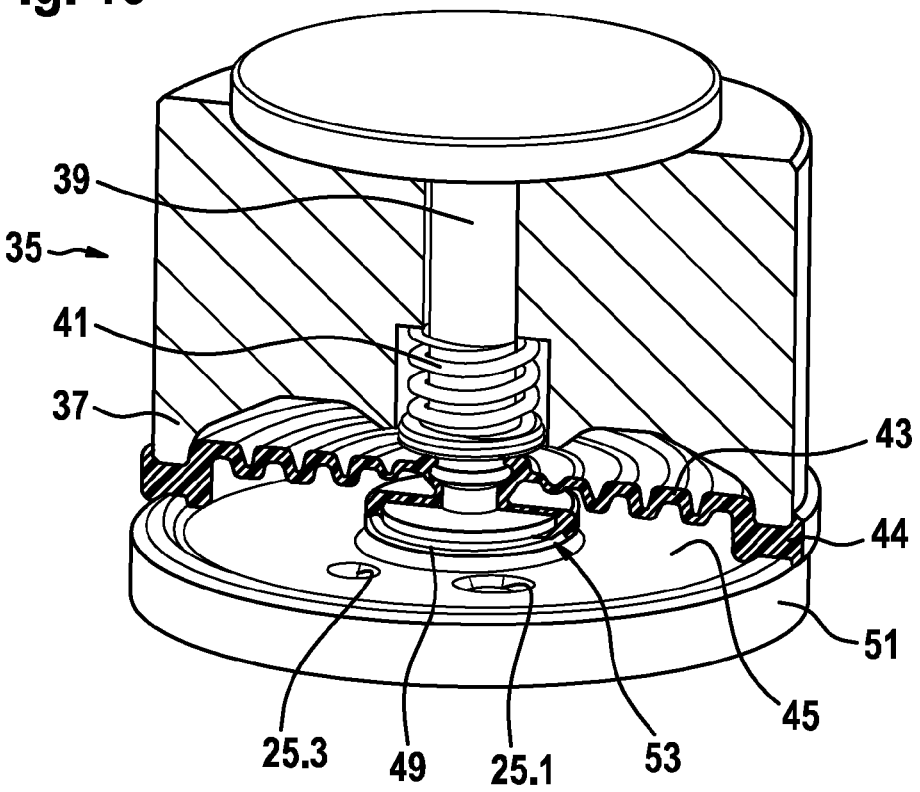

In FIG. 10, a further exemplary embodiment of an aeration according to the invention is likewise depicted partially in cross section. In this exemplary embodiment, a sandwich-like design of the aeration pump 15 can be easily recognized. From top to bottom, the armature 39 is adjoined by the diaphragm 43 comprising the bead 44 thereof and a valve diaphragm plate 51.

In this exemplary embodiment, it can also be easily recognized that a valve disk 53, which is overmolded with rubber or a similar elastic material, is formed at the end of the armature 39 which is the lower end in FIG. 10. The diaphragm 43 is produced from the same rubber material and is connected to the armature 39 in a positive-locking manner.

There is however a certain distance between the valve disk 53 and the diaphragm 43 in the axial stroke direction of the armature 39; thus enabling the pressure prevailing in the delivery chamber 45 to also act on the valve disk 53 "from above" in FIG. 10. As a result, the pressure prevailing in the delivery chamber 45 simultaneously acts as a hydraulic closing force which presses the valve disk 53 against the sealing seat 49 in the valve diaphragm plate 51.

In the exemplary embodiment depicted in FIG. 10, the diaphragm 43 is designed wavelike in cross section. In so doing, the diaphragm 43 is more elastic and can therefore be displaced more easily if the pressure increases in the delivery chamber 45. The diaphragm 43 in FIG. 10 is then displaced upwards in the direction of the armature 39 until said diaphragm rests against the armature 39. It is thereby ensured that the diaphragm 43 does not tear even when extremely large excess pressures occur in the delivery chamber 45.

Further connections can be seen in the valve diaphragm plate 51, namely the connection 25.1 and a connection 25.3. The pressure-side outlet 25.2 of the aeration pump 15 is covered in FIG. 10 by the valve disk 53.

The connection 25.3 establishes the hydraulic connection to the second check valve 31 (see FIG. 7) if the inventive aeration pump 15 is simultaneously used as a pressure equalization element.

Figure 11:
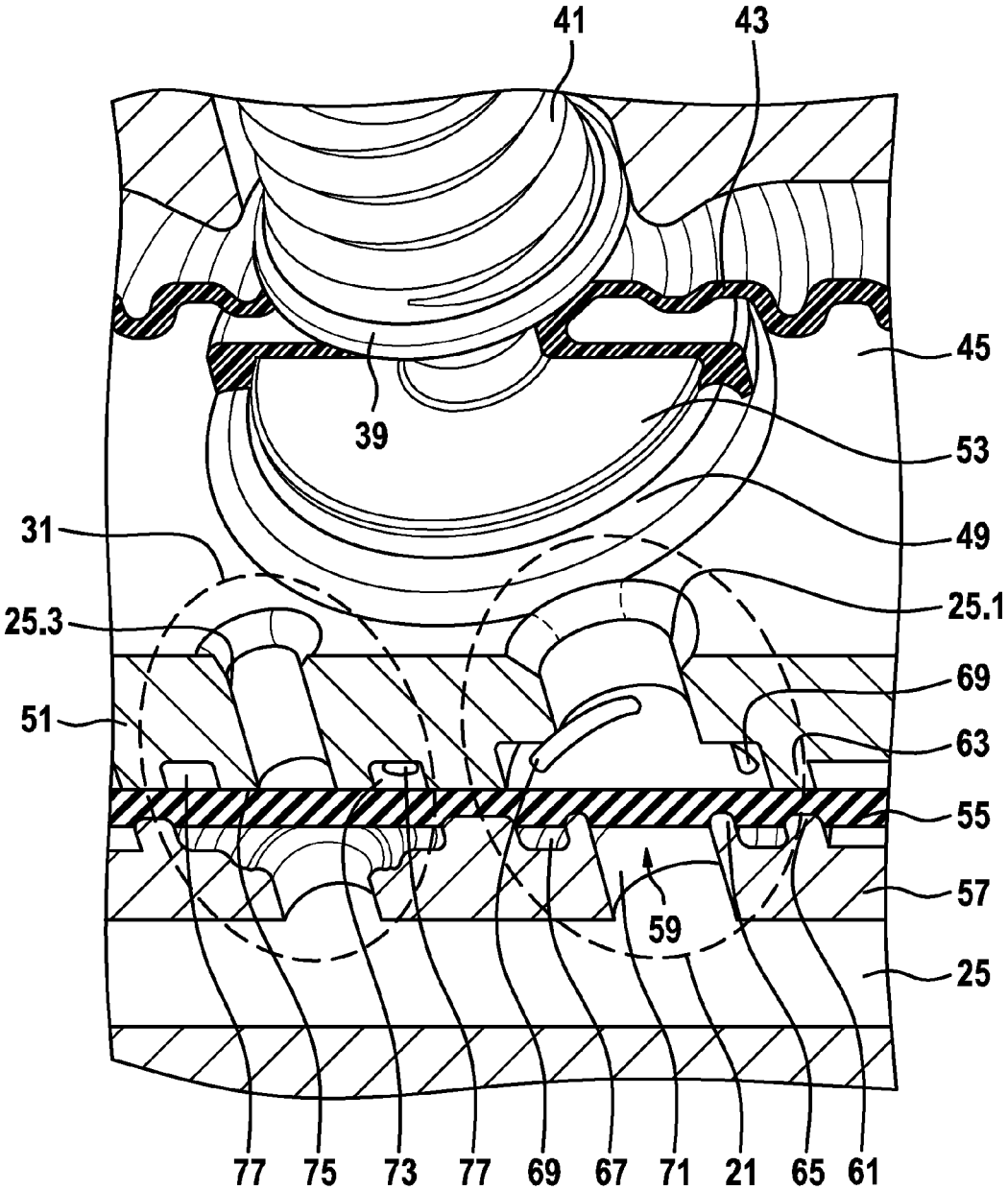

FIG. 11 shows a detail from FIG. 10 that is even further enlarged and is supplemented by a valve disk 57 as well as a rubber plate 55. A rubber plate 55 and a valve disk 57 are disposed below the valve diaphragm plate 51. The valve diaphragm plate 51, the rubber plate and the valve disk 57 form the check valve 21 below the connection 25.1, the blocking direction of said check valve running from top to bottom. The passage direction is indicated by an arrow 59. In order to illustrate which regions of the components 51, 55 and 57 form the check valve 21, said regions are enclosed by a dashed line.

A circumferential web 61 is formed in the valve disk 57. The circumferential web interacts with a corresponding web 63 of the valve diaphragm plate 51 such that said web 61 clamps the rubber plate 55 in a sealing manner. A sealing seat 65 is configured coaxially to the web 61 in the valve plate 57, on which seat the rubber plate 55 rests when the check valve 21 is closed. The sealing seat 65 and the web 61 together with the rubber plate 55 delimit an annular channel 67. Above the annular channel 67, a plurality of curvilinear apertures 69 are cut out in the rubber plate 55.

If the check valve 21 of the pressure line 7 (not depicted in FIG. 11) is now impinged via the aeration line 25 with the pressure prevailing in the pressure line 7 and this pressure is larger than the opening pressure of said check valve 21, the rubber plate 55 than lifts off the sealing seat 65 and a hydraulic connection thereby develops to the annular channel 67 in the valve plate 57. From the annular channel 67, the reducing agent enters by means of apertures 69 in the rubber plate 55 into the delivery chamber 45 of the aeration pump.

This means that reducing agent can flow in the direction of arrow 59 through the bore 69 in the valve plate 57 if the difference between the pressure in the bore 71 and that in the delivery chamber 45 is large enough.

As soon as the pressure of the reducing agent in the section 25.1 of the aeration line 25, which is connected to the pressure line 7, drops below the opening pressure of the check valve 21, the rubber plate 55 lowers again onto the sealing seat 65 due to the elasticity of said plate and consequently seals off the delivery chamber 45.

The second check valve 31 has the same design but the opposite passage direction. For that reason, the annular channel 73 and the sealing seat 75 are disposed in the valve diaphragm plate 51.

In FIG. 11, the apertures 77 in the rubber plate 55 associated with the second check valve 31 can only be seen to a minor extent.

When comparing the two check valves 21 and 31, it is apparent that the sealing seat 75 of the second check valve 31 is smaller than the diameter of the sealing seat 65 of the first check valve 21. As a result, the opening pressure of the two check valves 21 and 31 can be adjusted when the thickness of the rubber plate 55 is the same. As was already described in connection with FIG. 7, it is advantageous if the opening pressure of the second check valve 31 is higher than that of the first check valve 21, which can be constructively implemented by means of the smaller diameter of the sealing seat 75.

It is already clear from FIG. 11 that it is possible with minimal costs to integrate one or a plurality of check valves 21, 23, 31 into the aeration pump 15 according to the invention. Different variants of the inventive aeration pump 15 can thereby be produced by exchanging the valve diaphragm plate 51 or the valve disk 57.

Figure 12:
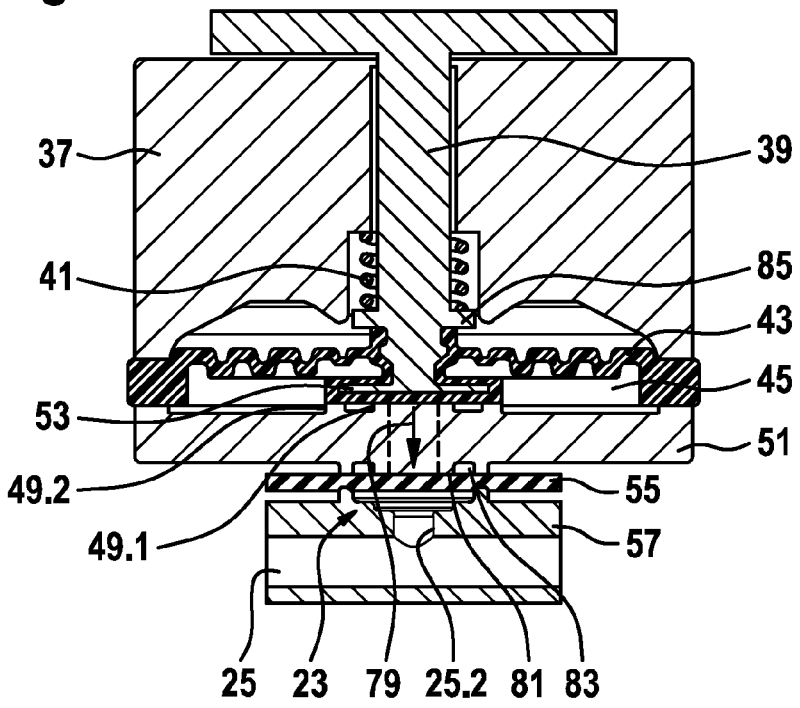

A side view of the exemplary embodiment pursuant to FIG. 11 is depicted in FIG. 12. In this embodiment, the check valve 23, which connects the delivery chamber 45 to the pressure-side section 25.2 of the aeration line 25, can be easily recognized. The passage direction of the check valve 23 is indicated by an arrow 79. Also in this case, the same design is again recognizable.

In the exemplary embodiment depicted in FIG. 12, an outer sealing seat 49.2 and an inner sealing seat 49.1 are formed in the valve diaphragm plate 51. The valve disk 53 rests on said sealing seats when the actuator is deenergized; thus enabling a particularly good sealing of the delivery chamber 45 towards the pressure side of the aeration pump 15 to take place. The inner sealing bead 49.1 results in a leak free sealing being possible by means of the closing forces brought to bear by the spring 41. This is primarily of importance when the motor vehicle has been shut down and the pressure line 7 and/or the dosing module and/or the exhaust gas system are to be reliably prevented from filling up with reducing agent without the spring 41 and thus the magnet 37 having to be larger than absolutely necessary.

A sealing seat 81 and an annular channel 83, which together with the rubber plate 55 constitutes the check valve 23, are formed in the valve diaphragm plate 51. It can be easily seen in this depiction how the valve disk 53 interacts with the sealing seat 49 and thereby relieves the second check valve 23.

It can also be easily recognized in FIG. 12 that the magnet 37 has a toroidal recess which delimits the stroke- or the elastic deformation of the diaphragm 43. As a result, damage to the diaphragm 43 can be prevented when inadmissibly high pressures occur in the delivery chamber 45.

A ledge 85 on the armature 39 allows on the one hand for the pressure spring 41 to be supported at the armature and on the other hand said ledge 85 can serve to guide the armature 39 in the magnet 37.

Figure 13:
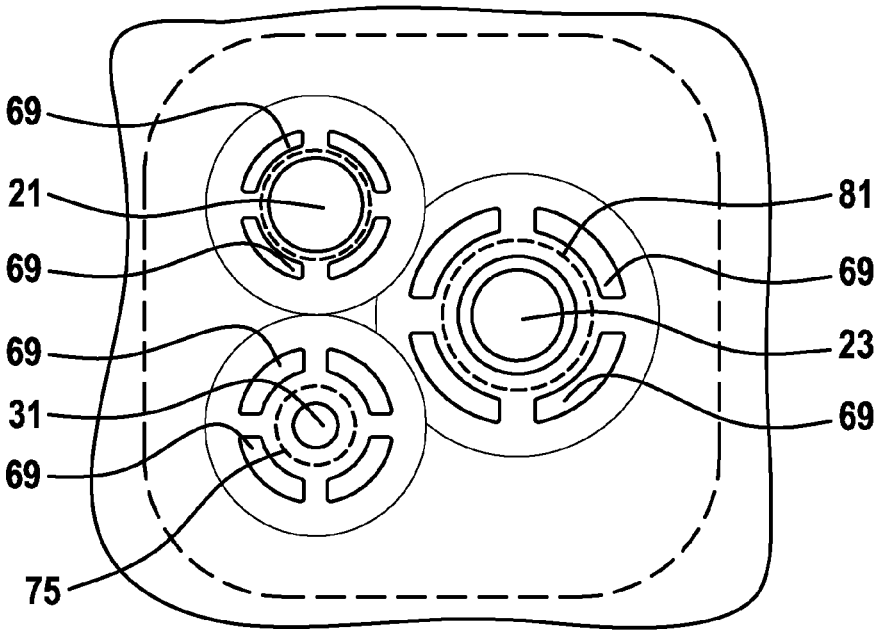

In FIG. 13, the rubber plate 55 is depicted transparently and "from below" so that the sealing seats in the valve diaphragm plate 51 and parts of the diaphragm 43 are also visible. The different diameters of the check valves 21, 23, 31 are also obvious in this depiction.

The check valve 23 has the largest bore so that said valve already opens when there is a small excess pressure in the delivery chamber if the valve disk 53 does not close said valve. The energy requirements are thereby minimized when the aeration pump 15 is operating. In contrast, the second check valve 31 has the smallest diameter of the sealing seat 75 on the suction side of the aeration pump 15 so that this check valve opens only at a relatively high pressure.

Figure 14:
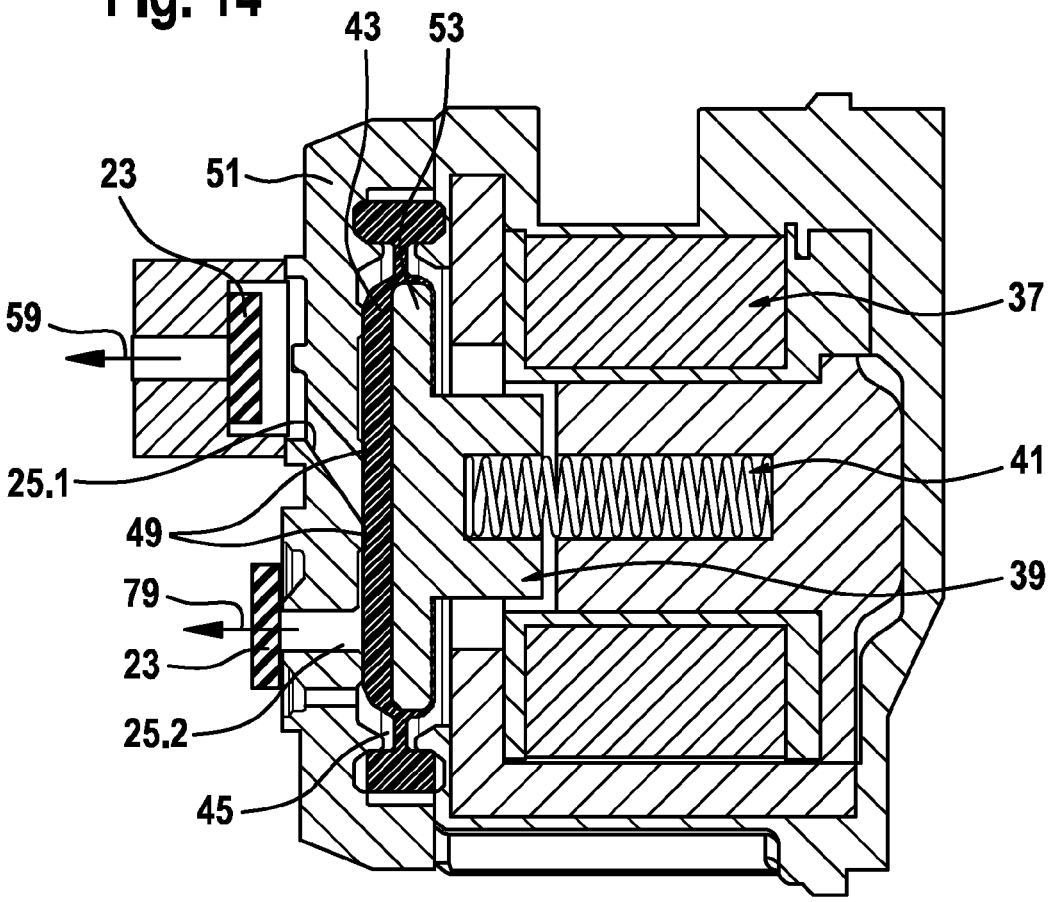
Figure 15:
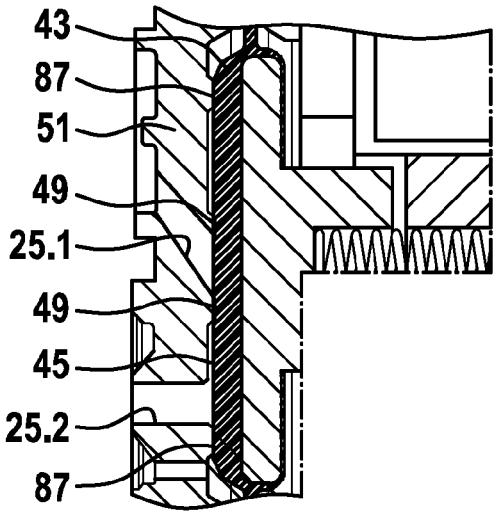
Figure 16:
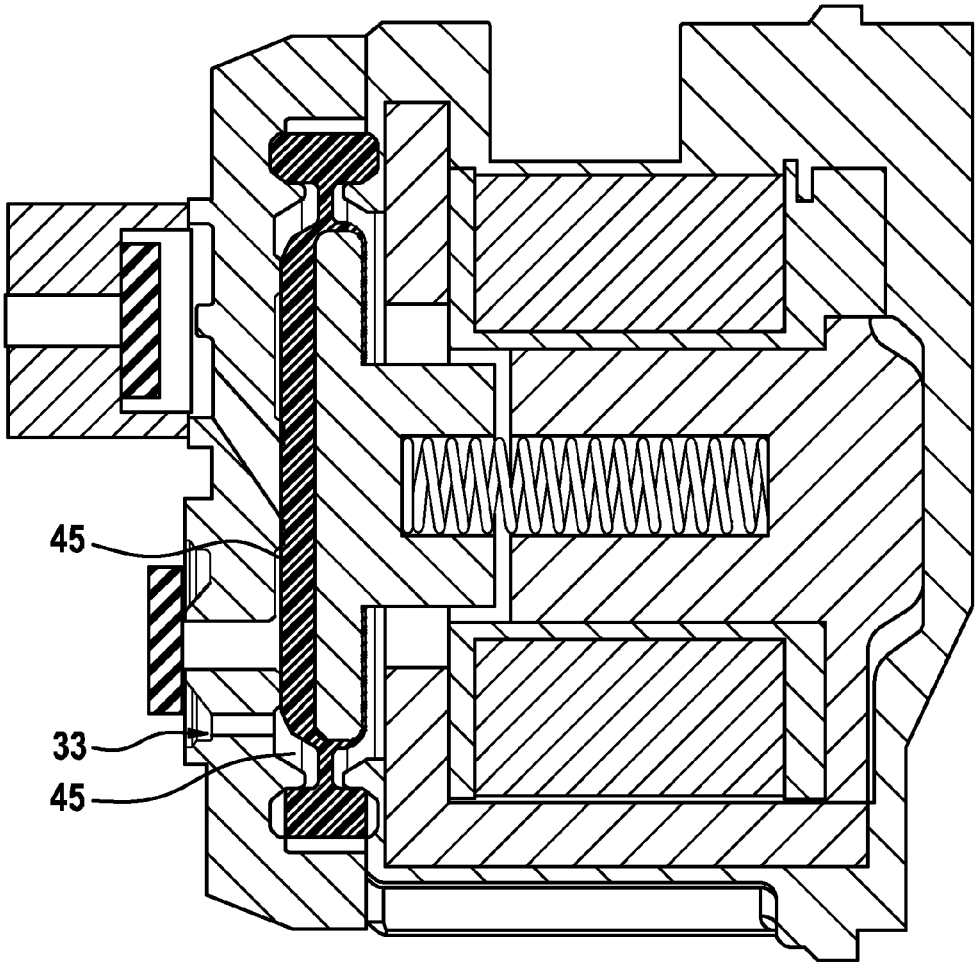

A further exemplary embodiment of an aeration pump 15 according to the invention is depicted in the FIGS. 14 to 16.

The check valves 21 and 23 are somewhat different in design than the ones previously described. The function thereof is however unchanged. It can easily be seen in FIGS. 14 and 15 how the diaphragm 43 rests on the sealing seat 49 which surrounds the connection 25.1 in the valve plate 51.

Particularly in FIG. 15 which represents an enlarged detailed depiction of FIG. 14, it can likewise be easily seen that the diaphragm 43 abuts against a further bead 87. The delivery chamber 45 thus has a circular ring-shaped geometry and is delimited radially on the outside by the bead 87 and on the inside by the sealing seat 49.

If liquid reducing agent is now drawn from the tank during the operation of the delivery pump 5 (see, e.g., FIG. 1), the pressure drops for a short time in the suction line 3. As a result, the check valve 23 opens in the pressure-side portion of the aeration line 25 and consequently the pressure also drops in the delivery chamber 45. This low pressure in the delivery chamber 45 also then remains intact on account of the blocking action of the check valve 23 if ambient pressure again prevails in the suction line 3.

Said low pressure in the delivery chamber 45 leads to the diaphragm 43 being pulled to some extent against the valve plate 51 or against the sealing seat 49 and the bead 87. This means that a very large force has to be produced by the armature 39 or the magnet 37 in order to lift the armature 39 and with it the diaphragm 43 from the sealing seat 49 and the bead 87. To meet this end, a larger, more expensive electrical actuator 35 would be required.

According to the invention, a throttle 33 is therefore formed in the valve plate 57 which connects the delivery chamber 45 to the aeration line 25.2 or indirectly to the suction line 3 (see the block diagram in FIG. 8 and also FIG. 16). The throttle 33 provides for an equalization in pressure between the suction line 3 and the delivery chamber 45 so that the forces which are required to lift the diaphragm 43 from the sealing seat 49 or the bead 87 are drastically reduced.

As a result, a smaller electrical actuator 35 can also be used, which saves on costs and installation space. In addition, the power requirements of the aeration pump 15 according to the invention are reduced.

The invention claimed is:

1. A dosing system for urea-water solution including a delivery module comprising a delivery pump (5), a dosing module (9) and a tank (1), the delivery pump having a suction side and a delivery side, wherein the delivery pump (5) and the tank (1) are connected to one another via a suction line (3) and wherein the delivery pump (5) and the dosing module (9) are connected to one another via a pressure line (7), characterized in that an aeration pump (15) is disposed parallel to the delivery pump (5), wherein the aeration pump has a suction side and a delivery side, wherein and in that the aeration pump (15) is connected to the dosing module (9) on the suction side of the aeration pump and to the tank (1) on the pressure side of the aeration pump; and wherein during operation of the aeration pump (15), urea-water solution is pumped from the dosing module (9) to the tank (1).

2. The dosing system according to claim 1, characterized in that at least one of the delivery pump (5) and the aeration pump (15) is a diaphragm pump.

3. The dosing system according to claim 1, characterized in that at least one of the delivery pump (5) and the aeration pump (15) is driven by an electromagnetic actuator (35).

4. The dosing system according to claim 1, characterized in that first check valves (17, 19, 21, 23) are provided on the suction side and the delivery side, respectively, of at least one of the delivery pump (5) and the aeration pump (15).

5. The dosing system according to claim 1, characterized in that at least one of a throttle (27, 33) and a diaphragm is provided on the suction side of at least one of the delivery pump (5) and the aeration pump (15).

6. The dosing system according to claim 4, characterized in that a second check valve (31) is provided on the suction side of the aeration pump (15) parallel to one of the first check valves (21), wherein a blocking direction of the second check valve (31) is opposite a blocking direction of the first check valve (21) and an opening pressure of the second check valve (31) is higher than the an opening pressure of the first check valve (21).

7. The dosing system according to claim 4, characterized in that at least one of a throttle (33) and a diaphragm is provided on the pressure side (25.2) of the aeration pump (15) parallel to one of the first check valves (23).

8. The dosing system according to claim 3, characterized in that a diaphragm (43) seals off one of the pressure line (7), the suction line (3) and the aeration line (25) when the actuator (35) is deenergized.

9. The dosing system according to claim 7, characterized in that the at least one of the throttle (27) and the diaphragm is disposed at an end of one of the pressure line (7), the suction line (3) and the aeration line (25), the end being sealed off by a diaphragm (43) when the actuator (35) is deenergized.

10. The dosing system according to claim 6, characterized in that an end of one of the pressure line (7), the suction line (3) and the aeration line (25), which end is sealed off by a diaphragm (43) when the actuator (35) is deenergized, is surrounded by a sealing seat (49, 65, 81).

11. The dosing system according to claim 3, characterized in that a diaphragm (43) directly or indirectly exerts a closing force on a valve member of one of the first check valves (17, 19, 21, 23) when the actuator (35) of the delivery pump (5) and/or of the aeration pump (15) is deenergized.

12. The dosing system according to claim 1, characterized in that the aeration pump (15) is integrated into the delivery pump (5).

13. The dosing system according to claim 1, further comprising at least one capacitor, wherein an electrical charge of the capacitor, which is stored in said capacitor, can be used to energize an electrical actuator (35) of the aeration pump (15).

14. The dosing system according to claim 1, characterized in that at least one of the delivery pump (5) and the aeration pump (15) comprises an electrical actuator (35) having a magnet (37) and an armature (39), a diaphragm (43), a valve diaphragm plate (51) and a valve disk (57), and wherein a rubber plate (55) serves as a valve element and sealing element between the valve diaphragm plate (51) and the valve disk (57).

15. The dosing system according to claim 14, characterized in that the aeration pump (15) comprises the valve diaphragm plate (51) and the diaphragm (45), which together form a controllable directional valve or check valve (26).

16. The dosing system according to claim 14, characterized in that the valve diaphragm plate (51), the rubber plate (55) and the valve disk (57) form at least one of a first suction-side check valve (21), a second suction-side check valve (31), a pressure-side check valve (23) and a throttle (27, 29, 33).

17. The dosing system according to claim 14, characterized in that the valve disk (53) is formed on the armature (39), wherein the valve disk (53) is overmolded with a material of the diaphragm (43) and the diaphragm (43) is disposed offset to the valve disk (53).

18. The dosing system according to claim 8, characterized in that the diaphragm (43) is configured to be wave-like in cross section.

19. The dosing system according to claim 14, characterized in that the armature (39) delimits the travel of the diaphragm (43) in a stroke direction.

* * * * *